US008405697B2

(12) United States Patent
Tsuchiya et al.

(10) Patent No.: US 8,405,697 B2
(45) Date of Patent: Mar. 26, 2013

(54) PRINTER

(75) Inventors: Motohito Tsuchiya, Shizuoka (JP); Hiroyasu Ishii, Shizuoka (JP); Hajime Yamamoto, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 35 days.

(21) Appl. No.: 13/215,488

(22) Filed: Aug. 23, 2011

(65) Prior Publication Data

US 2012/0050446 A1 Mar. 1, 2012

(30) Foreign Application Priority Data

Aug. 31, 2010 (JP) ..... 2010-194856

(51) Int. Cl.
*B41J 25/304* (2006.01)

(52) U.S. Cl. ..... 347/197; 400/120.16

(58) Field of Classification Search ..... 347/197, 347/198; 400/120.16, 120.17
See application file for complete search history.

(56) References Cited

U.S. PATENT DOCUMENTS 7,121,748 B1 * 10/2006 Sawai ..... 400/120.16
7,172,353 B2 * 2/2007 Sawai ..... 400/637
2006/0082636 A1 * 4/2006 Maruyama ..... 347/197

FOREIGN PATENT DOCUMENTS

JP 08-224933 9/1996

* cited by examiner

*Primary Examiner* — Huan Tran
(74) *Attorney, Agent, or Firm* — Turocy & Watson, LLP

(57) ABSTRACT

According to one embodiment, a printer includes a thermal head, a platen roller, and an urging mechanism configured to urge the thermal head against the platen roller. The printer further includes a first separation mechanism configured to move the thermal head from a proximal position where the thermal head is placed adjacent to the platen roller, to a first separation position where the thermal head is placed farther away from the platen roller than the proximal position, and a second separation mechanism configured to move the thermal head from the proximal position to a second separation position where the thermal head is placed farther away from the platen roller than the proximal position and placed closer to the platen roller than the first separation position. The printer further includes an electric-powered actuator having a movable member configured to reciprocate along a lengthwise direction of the printing medium.

9 Claims, 10 Drawing Sheets

PRINTER

CROSS-REFERENCE TO RELATED APPLICATIONS

This application is based upon and claims the benefit of priority from Japanese Patent Application No. 2010-194856, filed on Aug. 31, 2010, the entire content of which are incorporated herein by reference.

FIELD

Embodiments described herein relate generally to a printer.

BACKGROUND

Printers include a thermal head and a platen roller as the parts thereof, between which a printing medium such as a label may be interposed. Such a printer may have a configuration for separating the thermal head from the platen roller by means of an electric-powered actuator for maintenance purposes, e.g., for an operator to remove a printing medium jammed between the thermal head and the platen roller.

In such a printer, a number of parts may be required to perform such separation function. Accordingly, respective parts in the inside of the printer need to be arranged efficiently in terms of size or performance.

DETAILED DESCRIPTION

According to one embodiment, a printer including a thermal head configured to print on a printing medium having a strip shape and a platen roller configured to interpose the printing medium between the thermal head and the platen roller is disclosed. The printer further includes an urging mechanism configured to urge the thermal head against the platen roller. A first separation mechanism of the printer is configured to move the thermal head from a proximal position where the thermal head is placed adjacent to the platen roller to a first separation position where the thermal head is placed farther away from the platen roller than the proximal position, and a second separation mechanism thereof is also configured to move the thermal head from the proximal position to a second separation position where the thermal head is placed farther away from the platen roller than the proximal position and placed closer to the platen roller than the first separation position. The printer further includes an electric-powered actuator, which has a movable member configured to reciprocate along a lengthwise direction of the printing medium. The second separation mechanism further includes a first movement conversion mechanism configured to convert a linear movement of the movable member in one direction into a rotational movement of a first shaft in one rotational direction, the first shaft extending along a widthwise direction of the printing medium; and a second movement conversion mechanism configured to convert the rotational movement of the first shaft in one rotational direction into a movement of the thermal head from the proximal position to the second separation position.

Embodiments will now be described in detail with reference to the drawings.

A printer 1 according to one embodiment may print a label (i.e., print on a printing medium) which is provided on (e.g., attached to) an inner surface 2*a* of a web material 2 (e.g., a strip-shaped paper). In some embodiments, the printer 1 may print on a printing medium other than a label, for example, a continuous-form paper without a backing sheet. In addition, the printer 1 may write and read data to and from an RFID (Radio Frequency Identification) chip attached on a label.

Figure 1:
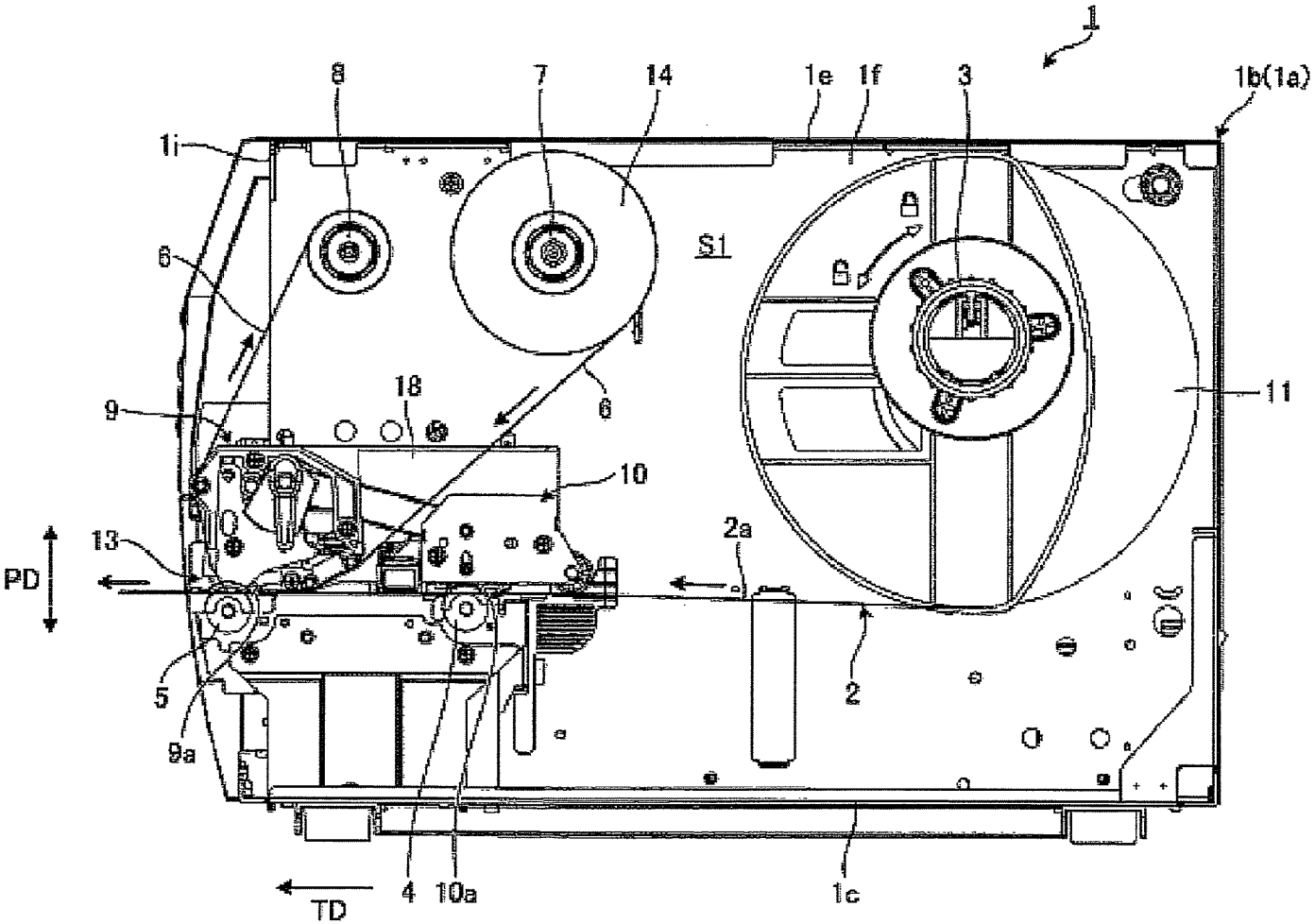
FIG. 1 is a side view showing an exemplary internal configuration of a printer according to one embodiment.
Figure 2:
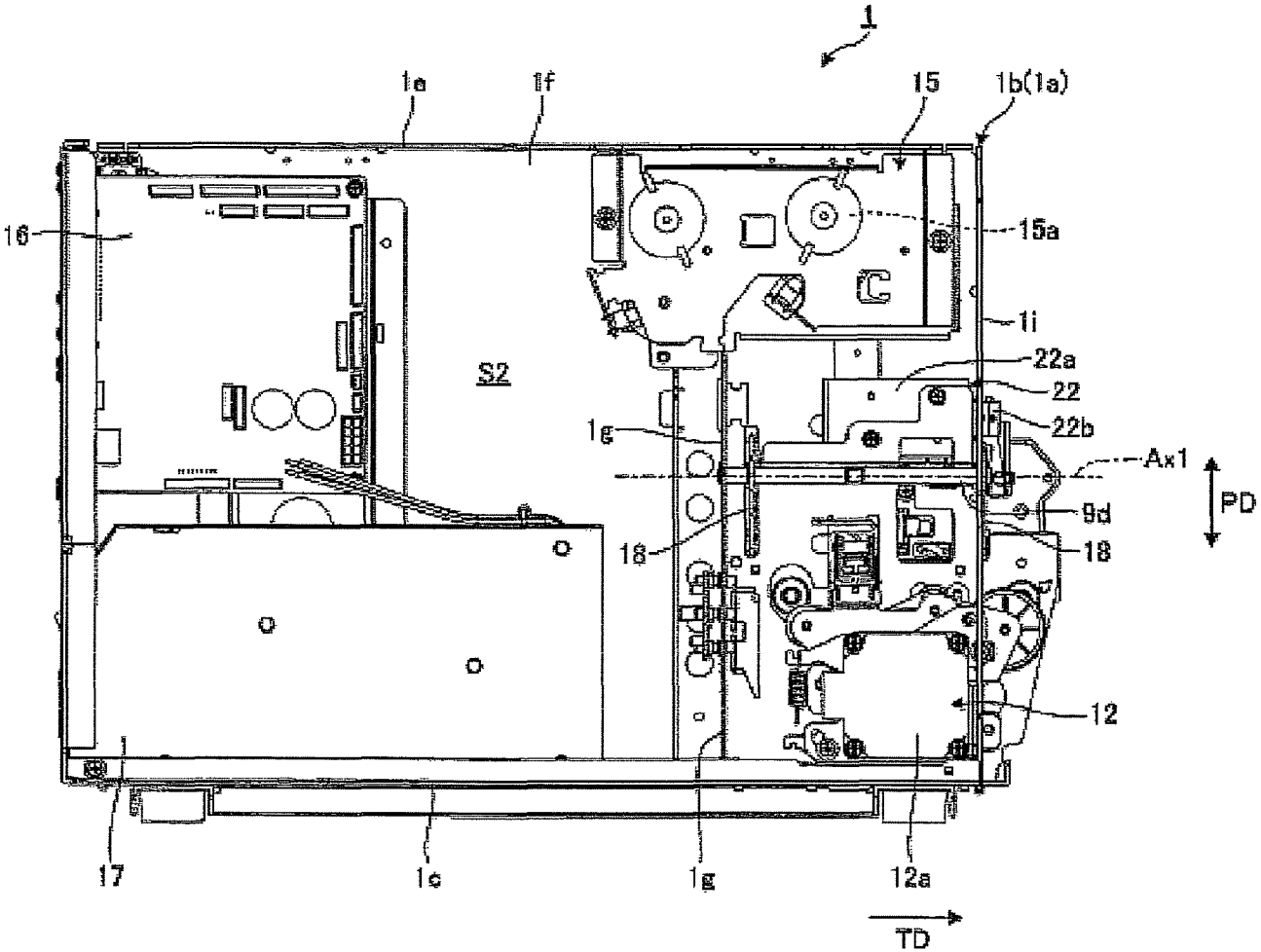
FIG. 2 is another side view showing an exemplary internal configuration of the printer, as seen from the opposite side of FIG. 1.

As shown in FIGS. 1 to 4, a main body 1*a* of the printer 1 includes a housing 1*b* with a bottom wall 1*c*, side walls 1*d* and a top wall 1*e*. The housing 1*b* includes a longitudinal wall 1*f* perpendicular to the bottom wall 1*c* but parallel to the side walls 1*d*. The housing 1*b* includes first and second compartments S1 and S2 which are separated from each other by the longitudinal wall 1*f*. These first and second compartments S1 and S2 are shown in FIGS. 1 and 2, respectively.

As shown in FIG. 1, in the first compartment S1, a roll holding shaft 3, a conveying roller 4, a platen roller 5, a supply shaft 7 for an ink ribbon 6, a take-up shaft 8 for the ink ribbon 6, a head block 9, a pinch roller block 10 and the like are mounted approximately perpendicular to the longitudinal wall 1*f*.

A roll (e.g., paper roll) 11, around which the web material 2 is wound, is supported by the roll holding shaft 3 rotatably with respect to an axis perpendicular to the longitudinal wall 1*f*. In one embodiment, the roll holding shaft 3 may be rotatably supported by the longitudinal wall 1*f*. Alternatively, the roll holding shaft 3 may be fixed on the longitudinal wall 1*f*, and instead the paper roll 11 with the web material 2 wound thereon may rotate around the fixed roll holding shaft 3. In any case, in this embodiment, the roll holding shaft 3 and the paper roll 11 are not driven by, for example, a motor. The paper roll 11 with the web material 2 wound thereon is rotated in conjunction with the rotation of the conveying roller 4 and the platen roller 5, which are installed downstream from the paper roll 11 in a paper feeding direction TD (the leftward direction in FIG. 1). As such, the web material 2 is discharged from the paper roll 11.

The conveying roller 4 and the platen roller 5 are driven to be rotated by means of a first rotation drive mechanism 12 equipped with a motor 12*a*, a gear, a belt or the like (see FIG. 2). The conveying roller 4 is installed upstream from the print unit 13 and the platen roller 5 in the paper feeding direction TD of the web material 2. The pinch roller block 10 includes a pinch roller 10*a* which is placed parallel to the conveying roller 4 and adjacent to an upper part of the conveying roller 4. The pinch roller 10*a* is urged against the conveying roller 4 with proper pressure. The web material 2, interposed between the conveying roller 4 and the pinch roller 10*a*, is conveyed in the paper feeding direction TD in response to a rotation of the conveying roller 4. In this embodiment, the conveying roller 4, the platen roller 5, the pinch roller 10*a*, the first rotation drive mechanism 12, a motor controller or the like may constitute a conveying mechanism.

A ribbon roll 14, around which a web material (e.g., ink ribbon 6) is wound, is provided on the supply shaft 7 for the ink ribbon 6. The take-up shaft 8 is driven to be rotated by means of a second rotation drive mechanism 15 equipped with a motor 15*a*, a gear, a belt or the like (see FIG. 2). By the rotation of the take-up shaft 8, the ink ribbon 6 is discharged from the ribbon roll 14 and in turn wound back around the take-up shaft 8. Both the ink ribbon 6 and the web material 2 are interposed between a thermal head 9*a* contained in the head block 9 and the platen roller 5. The thermal head 9*a* generates heat to melt or sublimate ink on the ink ribbon 6 so that a predetermined pattern such as a character, numeric character, bar code, or graphic, is transferred onto a label which is provided on (e.g., attached to) a surface (e.g., the inner surface 2*a*) of the web material 2. Specifically, in this embodiment, a print mechanism includes the platen roller 5, the thermal head 9*a*, the ink ribbon 6, the supply shaft 7, the take-up shaft 8, the second drive mechanism 15, the motor controller or the like. The print unit 13 includes the thermal head 9*a* and the platen roller 5.

As shown in FIG. 2, the second compartment S2 is provided with a circuit board 16 having electronic components such as a central processing unit (CPU) mounted thereon, and a power supply unit 17, in addition to the first rotation drive mechanism 12 and the second rotation drive mechanism 15. The first and the second rotation drive mechanisms 12 and 15 are provided downstream in the paper feeding direction TD, while the circuit board 16 and the power supply unit 17 are provided upstream in the paper feeding direction TD.

Figure 3:
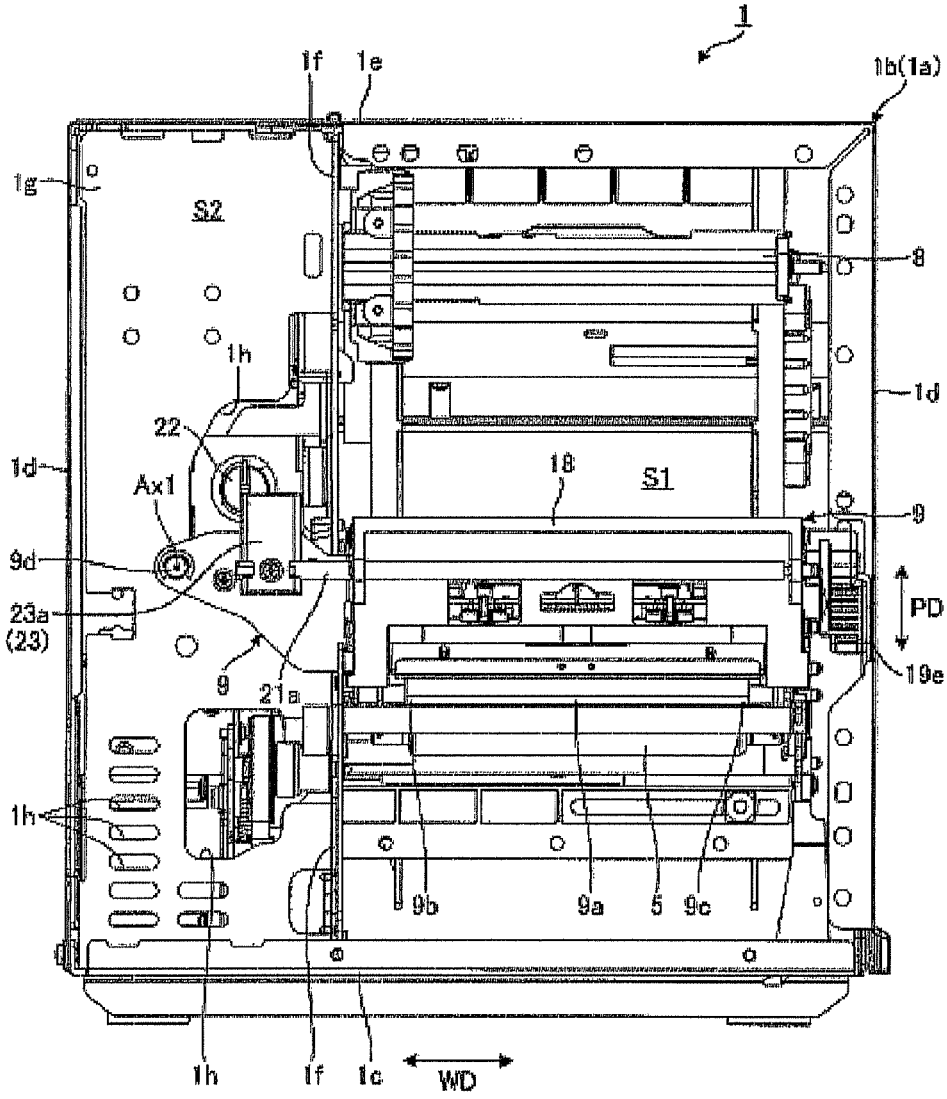
FIG. 3 is a front view showing an exemplary internal configuration of the printer, which represents a state where a head block is in a normal position.

As shown in FIGS. 2 and 3, in the second compartment S2, a partition wall 1*g* is disposed perpendicular to the longitudinal wall 1*f* and the bottom wall 1*c*, so that upstream and downstream regions in the paper feeding direction TD are separated from each other. The partition wall 1*g* includes a plurality of through-holes 1*h* formed thereon, which entails reduction in weight and good ventilation of the second compartment S2.

Figure 4:
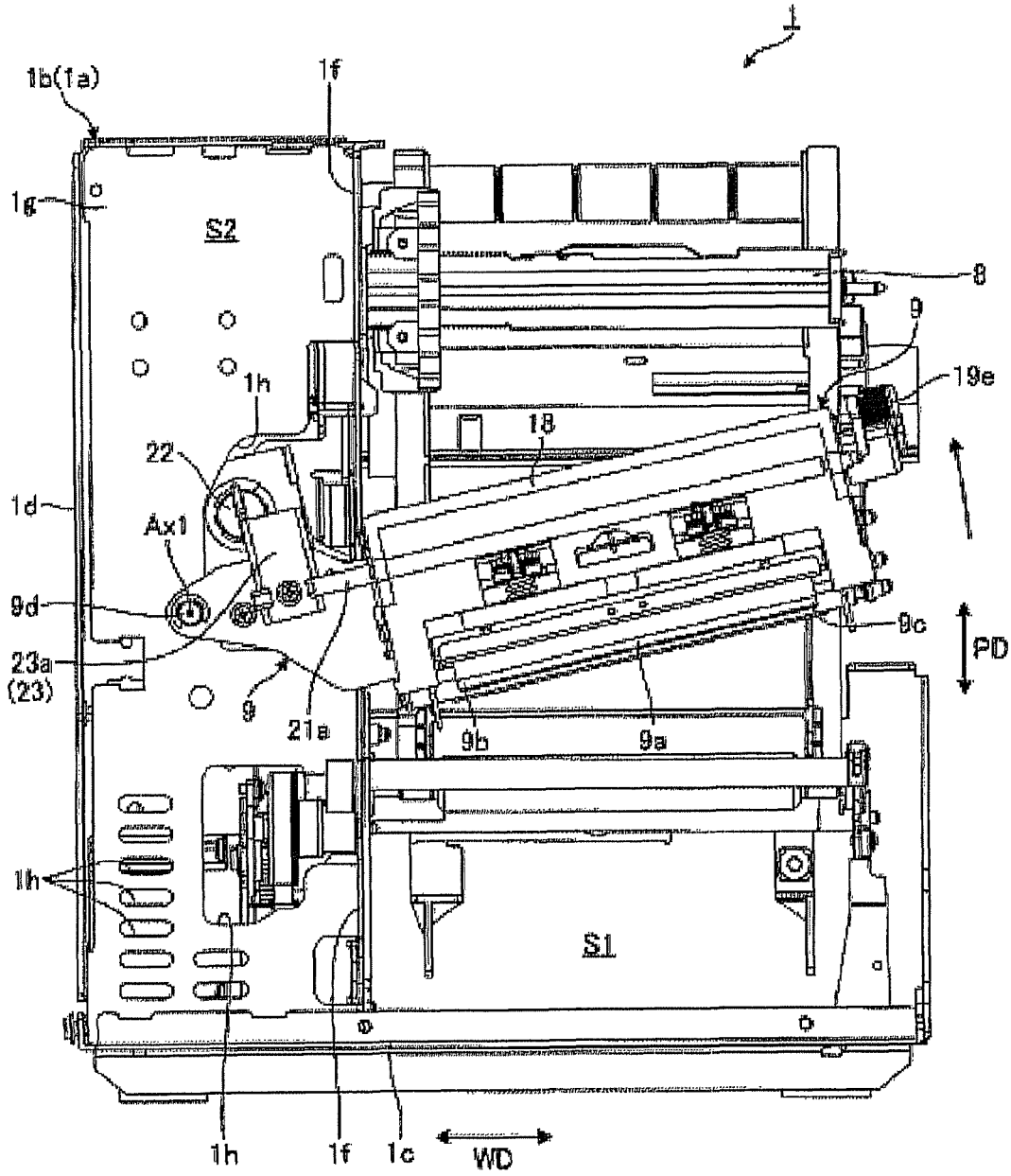
FIG. 4 is a front view showing an exemplary internal configuration of the printer, which represents a state where the head block is in a lift-up position.

In this embodiment, as shown in FIGS. 3 and 4, one end 9*b* of the head block 9 in a widthwise direction WD is rotatably supported by the partition wall 1*g* and a front wall 1*i* of the second compartment S2 so that the other end portion 9*c* of the head block 9 in the widthwise direction WD can be lifted upward (i.e., toward the top wall 1*e*). As shown in FIG. 2, a support shaft 9*d* is installed between the partition wall 1*g* and the front wall 1*i* in parallel with the longitudinal wall 1*f* and the bottom wall 1*c*. The head block 9 is rotatably supported around the center axis Ax1 of the support shaft 9*d* (i.e., an axis parallel to the longitudinal wall 1*f* and the bottom wall 1*c*). In one embodiment, the support shaft 9*d* may be rotatably supported by the partition wall 1*g* and the front wall 1*i*. Alternatively, the support shaft 9*d* may be fixed on the partition wall 1*g* and the front wall 1*i* and instead the head block 9 may be rotatably supported around the support shaft 9*d*. In this embodiment, the partition wall 1*g* and the front wall 1*i* serve as a block holding member. In a normal state as shown in FIG. 3, the thermal head 9*a* of the head block 9 is positioned parallel to the platen roller 5. In a lift-up state as shown in FIG. 4, the other end portion 9*c* of the head block 9 is lifted upward so that the head block 9 becomes inclined and thus a relatively large gap is formed between the platen roller 5 and the thermal head 9*a*. Under the lift-up state as shown in FIG. 4, an operator or user can easily perform various maintenance operations such as loading or replacing of the web material 2 or the ink ribbon 6, cleaning of the head block 9, upon detecting a printing failure or the like.

As shown in FIGS. 5 to 8, the head block 9 includes a base member 18 configured to support respective parts thereon. In the normal state as shown in FIG. 3, the base member 18 is fixedly mounted on the main body 1*a* (i.e., the housing 1*b*) of the printer 1. On the other hand, in the lift-up state as shown in FIG. 4, the other end portion 9*c* of the head block 9 is lifted up to be separated from the main body 1*a* (i.e., the housing 1*b*). Mounted on the base member 18 are an urging mechanism 19 configured to urge the thermal head 9*a* against the platen roller 5, a first separation mechanism 20 and a second separation mechanism 21 respectively configured to separate the thermal head 9*a* from the platen roller 5.

The urging mechanism 19 includes a shaft 19*a*, cams 19*b*, an interposing member 19*c*, coil springs 19*d*, and a handle 19*e*.

The shaft 19*a* extending along the widthwise direction WD is mounted between side walls 18*a* which are formed on both ends of the base member 18. The shaft 19*a* is rotatably supported around the center axis Ax2 by the side walls 18*a*. The handle 19*e* is connected at one end (that is located far from the longitudinal wall 1*f*) of the shaft 19*a*. In one embodiment, the shaft 19*a* serves as a second shaft.

The cams 19*b* rotate with the rotation of the shaft 19*a*. The cams 19*b* include a projecting portion 19*f* and a base portion 19*g* configured to release the urging of the thermal head by the projecting portion 19*f* (see FIGS. 7 and 8), respectively. The cams 19*b* abut against the interposing member 19*c* from a side opposite to the thermal head 9*a*, respectively.

Each of the coil springs 19*d* functioning as a compressing spring, is disposed immediately above the thermal head 9*a* and also between the interposing member 19*c* and a supporting member 9*e* on which the thermal head 9*a* is fixed. Each of the coil springs 19*d* is arranged to apply elastic force along a contact/separation direction PD to thereby make the thermal head 9*a* and the platen roller 5 come in contact with or separated from each other.

Figure 7:
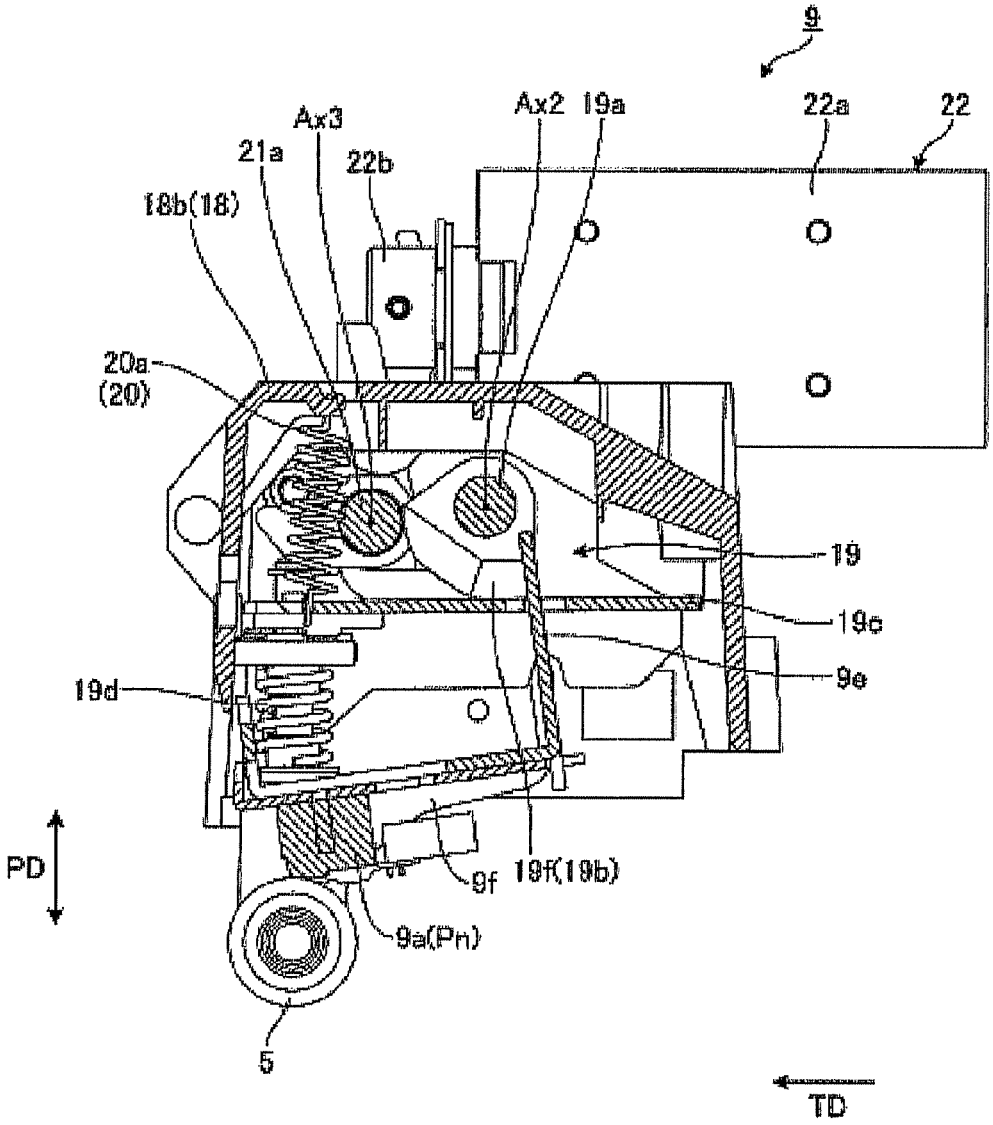
FIG. 7 is a sectional view taken along the line VII-VII in FIG. 6, which represents a state where a thermal head is in a proximal position.
Figure 8:
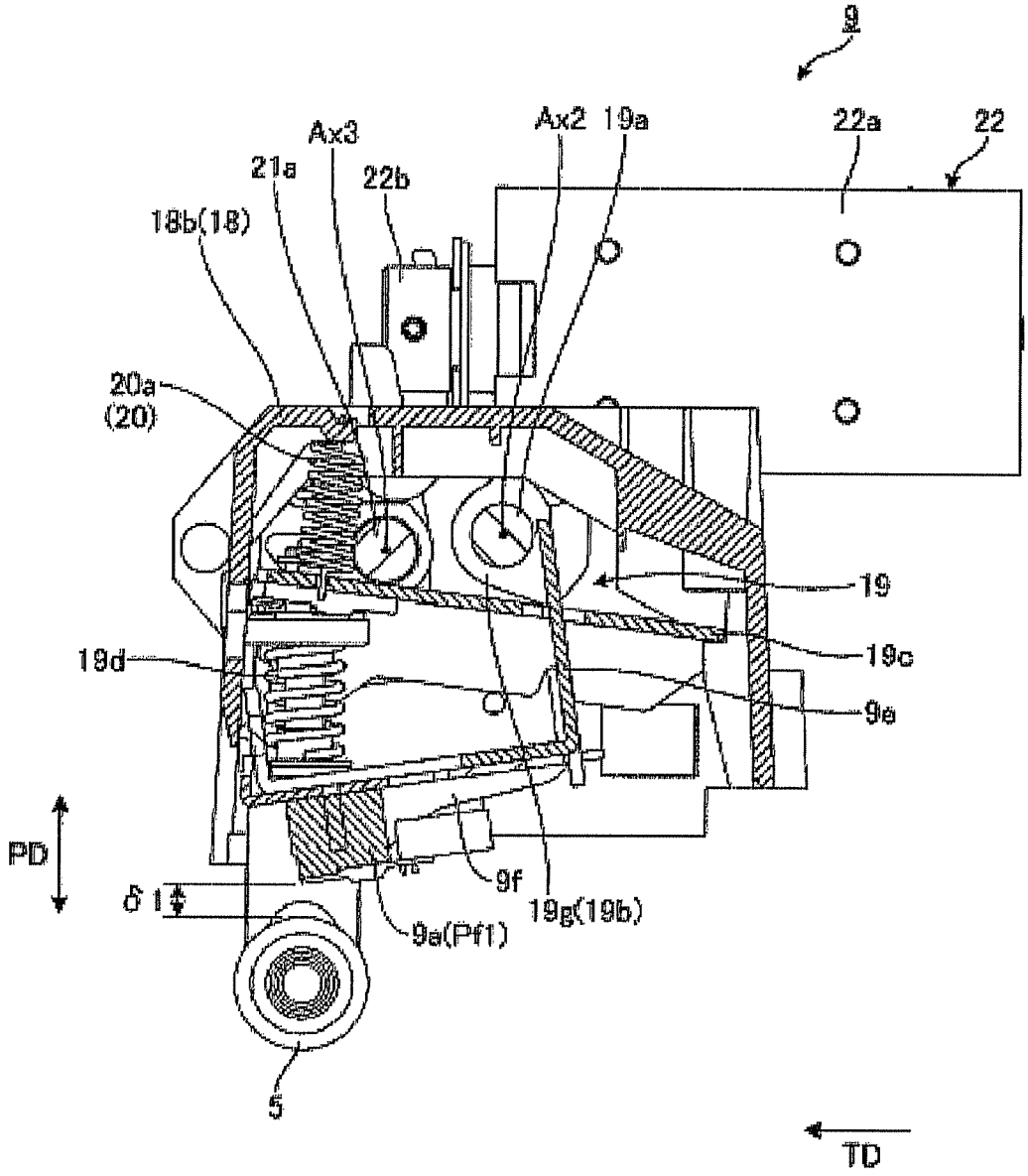
FIG. 8 is a sectional view taken along the line VII-VII in FIG. 6, which represents a state where the thermal head is in a first separation position.

In this arrangement, when the operator rotates the handle 19*e* by for example, his/her finger, it changes the configuration of the printer from a first abutting state where the base portion 19*g* of each of the cams 19*b* abuts against the interposing member 19*c*, as shown in FIG. 8, into a second abutting state where the projecting portion 19*f* of each of the cams 19*b* abuts against the interposing member 19*c*, as shown in FIG. 7, so that the interposing member 19*c* is urged toward the platen roller 5. As a result, the coil springs 19*d* are compressed along the contact/separation direction PD between the supporting member 9*e* and the interposing member 19*c*. Then, restoring force of each of the (compressed) coil springs 19*d* is applied to the thermal head 9*a*, so that the thermal head 9*a* is urged against the platen roller 5. A C-shaped cover 18*b* with one side opened toward the platen roller 5 is mounted between the side walls 18*a* of both ends of the base member 18 in the widthwise direction WD. In FIG. 7, Pn indicates a proximal position where the thermal head 9*a* is positioned proximate to the platen roller 5. In FIG. 8, Pf1 indicates a first separation position where the thermal head 9*a* is separated from the platen roller 5.

The first separation mechanism 20 includes a coil spring 20*a*, which is disposed between the cover 18*b* and the interposing member 19*c*. The coil spring 20*a* functions as an extension spring. Specifically, when the operator rotates the handle 19*e* by his/her finger, the configuration of the printer changes from the second abutting state where the projecting portion 19*f* of each of the cams 19*b* abuts against the interposing member 19*c*, as shown in FIG. 7, into the first abutting state where the base portion 19*g* of each of the cams 19*b* abuts against the interposing member 19*c*, as shown in FIG. 8, so that an elastic restoring force of the (extended) coil spring 19*d* is generated. Thus, the interposing member 19*c* moves in a direction of separating the thermal head 9*a* from the platen roller 5. As a result of such a movement of the interposing member 19*c*, the compression of the coil spring 19*d* is released and also the interposing member 19*c* may be locked to a locking member, so that the supporting member 9*e* and the thermal head 9*a* are displaced from the proximal position Pn to the first separation position Pf1. As described above, in this embodiment, the operator is able to manually operate the urging mechanism 19 and the first separation mechanism 20. Further, as shown in FIG. 8, the amount of a displacement of the thermal head 9*a* by the first separation mechanism 20 is represented by δ1.

An electric-powered actuator 22 is provided which includes a main body 22*a* (including an electromagnetic solenoid) mounted on a holder 18*c* of the base member 18, and a movable member 22*b* configured to reciprocate based on magnetic force that is generated when electric current is applied to the electromagnetic solenoid.

The second separation mechanism 21 includes a first movement conversion mechanism 23, second movement conversion mechanisms 24, and a shaft 21*a*.

Figure 9:
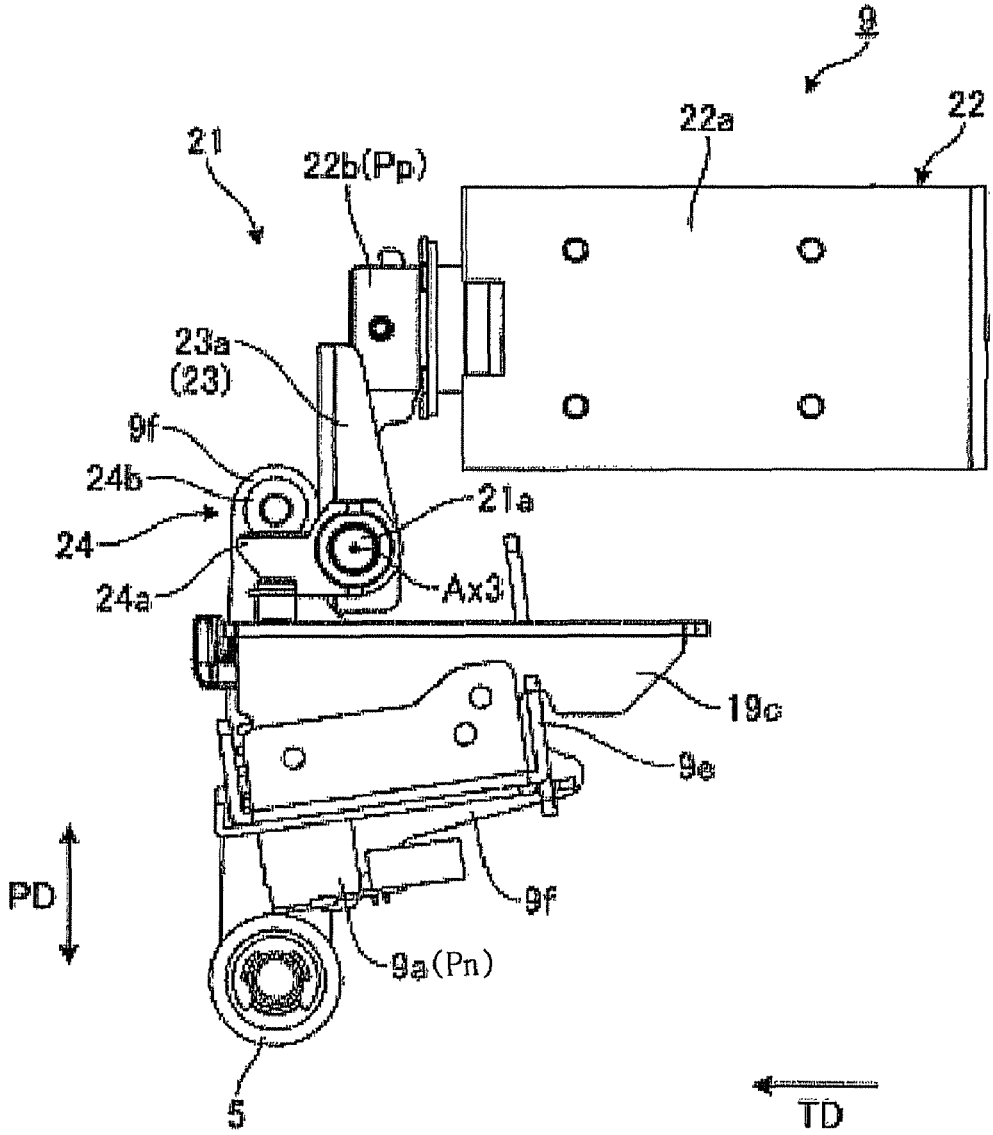
FIG. 9 is a side view showing a portion of the head block, which represents a state where the thermal head is in the proximal position.
Figure 10:
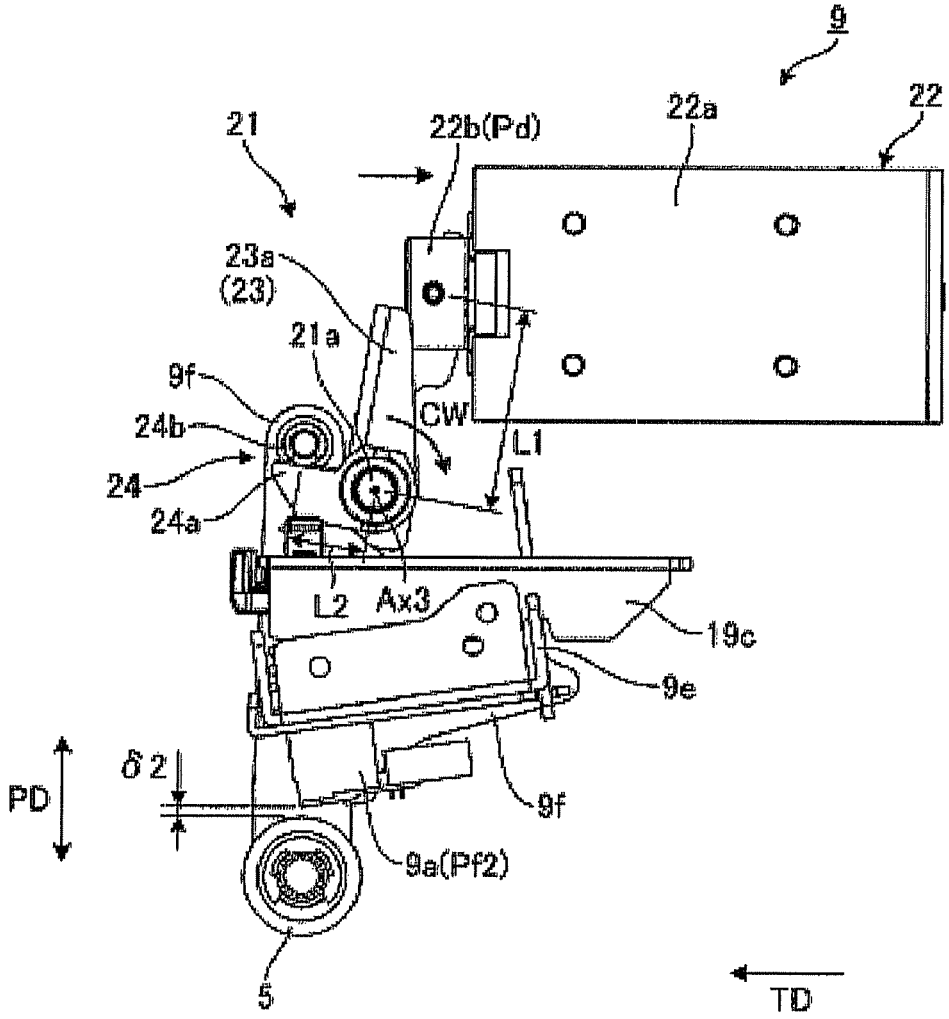
FIG. 10 is a side view showing a portion of the head block, which represents a state where the thermal head is in a second separation position.

The first movement conversion mechanism 23 is configured to convert a linear movement of the movable member 22*b* in one direction (in this embodiment, a movement toward a downstream side in the paper feeding direction TD) into a rotational movement of the shaft 21*a* around an axis in one rotational direction. The shaft 21*a* extending along the widthwise direction WD is mounted between the side walls 18*a* of the base member 18. Further, the shaft 21*a* is rotatably supported around the center axis Ax3 thereof by the side walls 18*a*. In one embodiment, the first movement conversion mechanism 23 may be implemented with a link mechanism, which includes a link arm 23*a* connected to both the movable member 22*b* and the shaft 21*a* and configured to be rotatable around an axis parallel to the center axis Ax3. As shown in FIGS. 9 and 10, in one embodiment, as the movable member 22*b* is moved from a pull-out position Pp downstream in the paper feeding direction TD to a pull-in position Pd upstream in the paper feeding direction TD, the first movement conversion mechanism 23 rotates the shaft 21*a* in the clockwise direction CW as shown in FIGS. 9 and 10.

Figure 5:
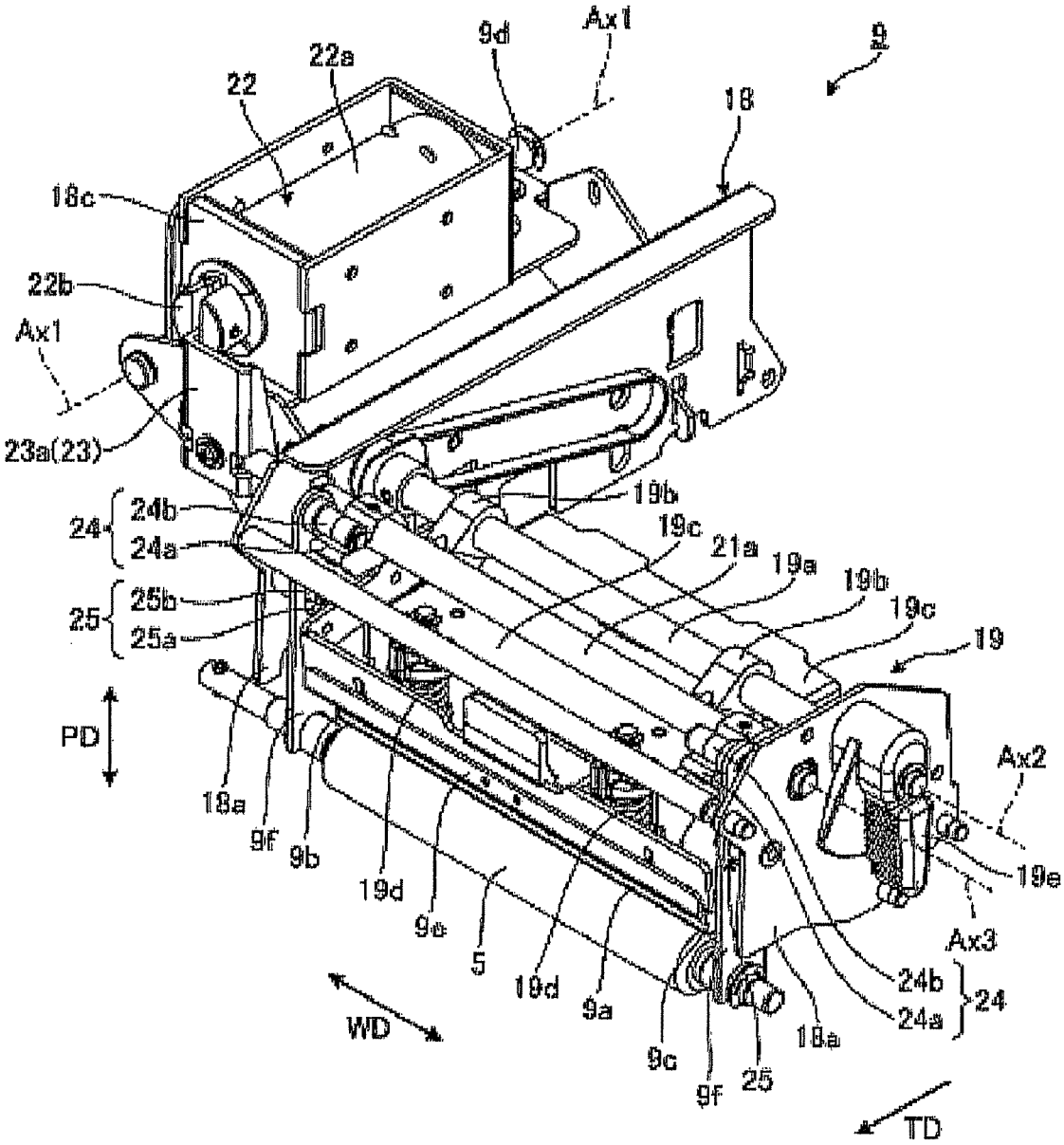
FIG. 5 is a perspective view showing a portion of an exemplary head block provided in the printer.

Each of the second movement conversion mechanisms 24 includes an engaging portion 24*a* and an engaged portion 24*b*. As shown in FIG. 5, the engaging portions 24*a* are fixed to both ends of the shaft 21*a* in the widthwise direction WD and protrude from the shaft 21*a* toward a radial outer side of the center axis Ax3. The engaged portions 24*b* are disposed at positions respectively corresponding to the engaging portions 24*a* and at an opposite side to the platen roller 5 with respect to the engaging portions 24*a*. In FIG. 9, the engaging portion 24*a* and the engaged portion 24*b* may be disposed such that they keep in contact with each other, or such that they are slightly separated from each other. The engaged portions 24*b* are fixed on a pair of side plates 9*f* disposed at both ends of the thermal head 9*a* in the widthwise direction WD. The pair of side plates 9*f* is a part of the supporting member 9*e* and extends along the contact/separation direction PD along which the thermal head 9*a* is in contact with and also separated from the platen roller 5.

Figure 6:
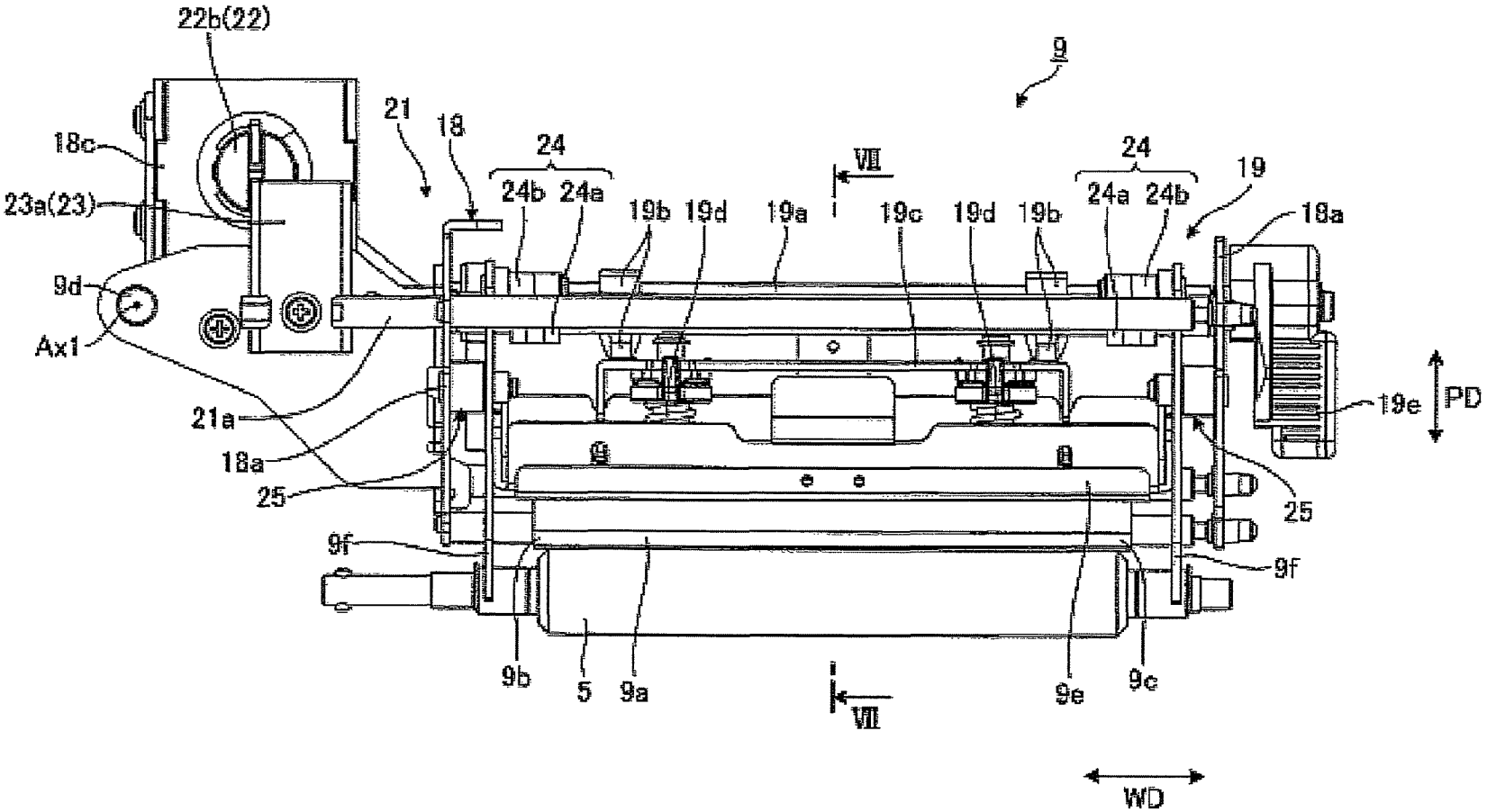
FIG. 6 is a front view showing a portion of the head block provided in the printer.

As shown in FIG. 6, the pair of side plates 9*f* is disposed inside and in parallel to the pair of side walls 18*a* of the base member 18 to be respectively spaced apart from but close to the pair of side walls 18*a* in the widthwise direction WD. In one embodiment, a pair of guide mechanisms 25 is provided between the pair of side plates 9*f* and the pair of side walls 18*a*, which are placed adjacent to each other, so that the pair of guide mechanisms 25 can guide a relative displacement between the pair of side plates 9*f* and the pair of side walls 18*a* along the contact/separation direction PD. For example, as shown in FIG. 5, the guide mechanisms 25 may be configured to include a peripheral portion of an elongated hole 25*a*, which is formed on the side plate 9*f* and extends along the contact/separation direction PD, and a slider 25*b*, which is formed on the side wall 18*a* and is inserted into the elongated hole 25*a*. In this configuration, as the slider 25*b* is guided to move relative to the elongated hole 25*a* along the longitudinal direction of the elongated hole 25*a* within the peripheral portion of the elongated hole 25*a*, the thermal head 9*a* fixed to the supporting member 9*e* moves relatively to the platen roller 5 along the contact/separation direction PD.

In this configuration, as shown in FIGS. 9 and 10, when the movable member 22*b* of the electric-powered actuator 22 moves from the pull-out position Pp to the pull-in position Pd and in turn the shaft 21*a* rotates in the clockwise direction CW by means of the first movement conversion mechanism 23, the engaging portion 24*a* pushes up the engaged portion 24*b* upward as shown in FIGS. 9 and 10. Then, the side plates 9*f* and the thermal head 9*a* fixed to the side plates 9*f* are moved upward, i.e., in a direction of separating the thermal head 9*a* from the platen roller 5. As a result, the supporting member 9*e* and the thermal head 9*a* move from the proximal position Pn as shown in FIG. 9 to the second separation position Pf2 as shown in FIG. 10. That is, in one embodiment, the second separation mechanism 21 may be electrically operated under control of a control unit. The amount of a displacement of the thermal head 9*a* by the second separation mechanism 21 is represented by δ2, as shown in FIG. 10. In some embodiments, for instance, the second separation mechanism 21 may operate when the operator wants to convey only the web material 2. In case the operator wants to convey only the web material 2 without involving any printing operation, if both the web material 2 and the ink ribbon 6 are interposed between the thermal head 9*a* and the platen roller 5, it may cause unnecessary consumption of the ink ribbon 6 not fundamentally required. In such a case, in one embodiment, the second separation mechanism 21 separates the thermal head 9*a* from the platen roller 5 so that only the web material 2 is conveyed, thus avoiding the unnecessary consumption of the ink ribbon 6.

As described above, the second separation mechanism 21 of the printer 1 includes the first movement conversion mechanism 23 and the second movement conversion mechanism 24. A configuration of the related art in which an electric-powered actuator directly separates a thermal head from a platen roller without an operation for changing a movement direction may have a restriction in arranging the electric-powered actuator inside the printer, which may make it difficult to arrange the electric-powered actuator in the printer. On the other hand, in the printer 1 according to the above embodiment, the second separation mechanism 21 includes the first movement conversion mechanism 23 and the second movement conversion mechanism 24, which makes it possible to provide sufficient freedom of arrangement of the electric-powered actuator 22.

Further, in the above embodiment, the second movement conversion mechanism 24 includes the plurality of engaging portions 24*a*, which are spaced apart from each other on the shaft 21*a* along the widthwise direction WD of the web material 2. The rotation of the shaft 21*a* causes the plurality of engaging portions 24*a* to engage the supporting member 9*e* of the thermal head 9*a*, to thereby separate the thermal head 9*a* from the platen roller 5. This makes it easier to decrease a deviation in the separation amount of the thermal head 9*a* from the platen roller 5 along the widthwise direction WD.

In some embodiments, a roller may be provided on at least one of the engaging portion 24*a* and the engaged portion 24*b*, which rotates when in contact with the other one. Such a configuration may lead to improved endurance compared to the configuration in which the engaging portion 24*a* and the engaged portion 24*b* are in a sliding relationship to each other.

Further, in the above embodiment, as shown in FIG. 2, the first rotation drive mechanism 12 is arranged below the electric-powered actuator 22 and the second rotation drive mechanism 15 is arranged above the electric-powered actuator 22 such that the electric-powered actuator 22 can be longitudinally provided in a horizontal direction. With this arrangement, it is possible to efficiently array the electric-powered actuator 22 in the inside of the printer 1, thus allowing the size of the printer 1 to be smaller.

Further, in the above embodiment, as shown in FIGS. 3 and 4, the electric-powered actuator 22 is disposed at the opposite side to the thermal head 9*a* with respect to the rotation center axis Ax1 of the head block 9, i.e., above the center axis Ax1. For example, in case the electric-powered actuator 22 is disposed below the center axis Ax1, rotation of the head block 9 renders the electric-powered actuator 22 to be located near the longitudinal wall 1*f* side, which interferes with the lift-up of the head block 9. In the above embodiment, as described above, since electric-powered actuator 22 is disposed at the opposite side of the thermal head 9*a* with respect to the rotational center axis Ax1 of the head block 9, i.e., above the center axis Ax1, when the head block 9 is lifted up, the electric-powered actuator 22 moves in a direction of being separated from the longitudinal wall 1*f* inside the second compartment S2, without affecting the lift-up operation of the head block 9.

Further, in the above embodiment, the shaft 21*a* of the second separation mechanism 21 is disposed closer to the thermal head 9*a* than the shaft 19*a* of the urging mechanism 19. In case the two shafts 19*a* and 21*a* have to be disposed within the limited space inside the housing 1*b* of the printer 1, and if the shaft 21*a* of the second separation mechanism 21 is disposed farther than the shaft 19*a* of the urging mechanism 19, a moment arm of rotational torque with respect to the center axis Ax3, which is required for the second movement conversion mechanism 24 to separate the thermal head 9*a* from the platen roller 5, may be extended. This requires the electric-powered actuator 22 to have a more powerful driving force. In the above embodiment, since the shaft 21*a* of the second separation mechanism 21 is disposed closer to the thermal head 9*a* compared to the shaft 19*a* of the urging mechanism 19, the moment arm of rotational torque with respect to the center axis Ax3, which is required for the second movement conversion mechanism 24 to separate the thermal head 9*a* from the platen roller 5, may be further shortened. As a result, it is possible to reduce the driving force of the electric-powered actuator 22.

Furthermore, in the above embodiment, since the electric-powered actuator 22 is disposed above and spaced apart from the shaft 21*a*, the length of the link arm 23*a* may be increased. Accordingly, this may increase the length of the moment arm of the first movement conversion mechanism 23 (as indicated by L1 in FIG. 10) compared to the length of the moment arm of the second movement conversion mechanism 24 (as indicated by L2 in FIG. 10), which, in turn, may also reduce the driving force of the electric-powered actuator 22.

Furthermore, in the above embodiment, the shaft 19*a* of the urging mechanism 19 is disposed upstream from the shaft 21*a* of the second separation mechanism 21 in the paper feeding direction TD. Respective parts of the urging mechanism 19, the first separation mechanism 20 and the second separation mechanism 21 (for example, in the above embodiment, the coil spring 19*d*, the coil spring 20*a* and the shaft 21*a*) are disposed along a direction perpendicular to the paper feeding direction TD with respect to the thermal head 9*a*, i.e., along the contact/separation direction PD. In this arrangement, the shaft 19*a* (and the cam 19*b*) of the urging mechanism 19 may be disposed upstream from the shaft 21*a* of the second separation mechanism 21 in the paper feeding direction TD, so that the above described parts can be efficiently arranged in the printer 1. Further, since the parts (e.g., the coil springs 19*d* and 20*a*, the engaged portion 24*b* or the like), for applying external force to the supporting member 9*e* of the thermal head 9*a* to make contact with or be separated from the platen roller 5, may be arranged at positions along the contact/separation direction PD with respect to the thermal head 9*a* (in the above embodiment, above the thermal head 9*a*), an unnecessary increase in the length of a moment arm is restrained. On the other hand, since the shaft 19*a* and the cam 19*b* of the urging mechanism 19 apply force to the coil spring 19*d* through the interposing member 19*c*, shaft 19*a* and the cam 19*b* do not have to be arranged at positions along the contact/separation direction PD with respect to the thermal head 9*a*, but rather the shaft 19*a* of the urging mechanism 19 may be arranged upstream from the thermal head 9*a* in the paper feeding direction TD.

While certain embodiments have been described, these embodiments have been presented by way of example only, and are not intended to limit the scope of the inventions. Indeed, the embodiments described herein may be embodied in a variety of other forms. For example, the present disclosure is applicable to a printer having none of the ink ribbon (e.g., a printer configured to perform printing on a thermal paper or the like). Furthermore, the thermal head may be urged against the platen roller by means of the coil spring used as an extension spring, or an urging member such as a plate spring other than the coil spring. In addition, a specification (a scheme, structure, shape, size, arrangement, location, number, length, width, thickness, cross-section area, weight, material or the like) of each part (a print unit, thermal head, urging mechanism, first separation mechanism, second separation mechanisms, electric-powered actuator, first operation converting mechanism, second operation converting mechanism, shaft, supporting member, rotational direction, first rotary drive mechanism, second rotary drive mechanism, head block, block supporting member, second shaft, cam, projecting portion or the like) may be modified in a variety of other forms.

According to the above embodiments, it is possible to obtain a printer in which various parts can be more efficiently arranged therein.

What is claimed is:

1. A printer, comprising:

a thermal head configured to print on a printing medium;

a platen roller configured to interpose the printing medium between the thermal head and the platen roller;

an urging mechanism configured to urge the thermal head against the platen roller;

a first separation mechanism configured to move the thermal head from a proximal position where the thermal head is placed adjacent to the platen roller to a first separation position where the thermal head is placed farther away from the platen roller than the proximal position;

a second separation mechanism configured to move the thermal head from the proximal position to a second separation position where the thermal head is placed farther away from the platen roller than the proximal position and placed closer to the platen roller than the first separation position; and an electric-powered actuator having a movable member configured to reciprocate along a lengthwise direction of the printing medium, wherein the second separation mechanism includes:

a first movement conversion mechanism configured to convert a linear movement of the movable member in one direction into a rotational movement of a first shaft in one rotational direction, the first shaft extending along a widthwise direction of the printing medium; and a second movement conversion mechanism configured to convert the rotational movement of the first shaft in one rotational direction into a movement of the thermal head from the proximal position to the second separation position.

2. The printer of claim 1, wherein the second movement conversion mechanism further includes a plurality of engaging portions provided on the first shaft spaced apart from each other in the widthwise direction, and configured to engage and thereby move a supporting member configured to support the thermal head in response to the rotational movement of the first shaft, such that the thermal head is separated from the platen roller.

3. The printer of claim 1, further comprising:

a first rotation drive mechanism provided below the electric-powered actuator and configured to rotate the platen roller; and a second rotation drive mechanism provided above the electric-powered actuator and configured to rotate a take-up shaft for a ribbon roll, wherein the electric-powered actuator is longitudinally provided in a horizontal direction.

4. The printer of claim 1, further comprising:

a head block including the thermal head, the urging mechanism, the first separation mechanism and the second separation mechanism; and a block supporting member configured to rotatably support one end of the head block in the widthwise direction such that the other end of the head block in the widthwise direction is capable of being lifted up, wherein the electric-powered actuator is provided at an opposite position to the thermal head with respect to a first center axis of rotation of the head block and above the first center axis.

5. The printer of claim 1, wherein the urging mechanism includes:

a second shaft, extending along the widthwise direction, provided farther than the first shaft from the thermal head and configured to be rotatably supported around a second center axis; and a cam provided on the second shaft and including a projecting portion configured to urge the thermal head in response to rotation of the second shaft.

6. The printer of claim 5, wherein the second shaft is provided upstream from the first shaft in a direction of conveying the printing medium.

7. The printer of claim 1, wherein the first movement conversion mechanism includes a link mechanism connected to the movable member and the first shaft.

8. The printer of claim 5, wherein the cam further includes a base portion configured to release the urging of the thermal head by the projecting portion.

9. The printer of claim 8, wherein the first separation mechanism comprises:

a first spring configured to move the thermal head to the proximal position when the projecting portion of the cam abuts the thermal head; and a second spring configured to move the thermal head to the first separation position when the base portion releases the urging of the thermal head by the projecting portion.

* * * * *